US011342106B2

(12) United States Patent
Kusawake et al.

(10) Patent No.: US 11,342,106 B2
(45) Date of Patent: May 24, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kazushi Kusawake, Mie (JP); Shintaro Nanbara, Mie (JP); Yusaku Maeda, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 463 days.

(21) Appl. No.: 16/486,338

(22) PCT Filed: Feb. 8, 2018

(86) PCT No.: PCT/JP2018/004417
§ 371 (c)(1),
(2) Date: Aug. 15, 2019

(87) PCT Pub. No.: WO2018/159255
PCT Pub. Date: Sep. 7, 2018

(65) Prior Publication Data

US 2019/0385778 A1 Dec. 19, 2019

(30) Foreign Application Priority Data

Feb. 28, 2017 (JP) ..... JP2017-036001

(51) Int. Cl.
*H01F 27/32* (2006.01)
*H01F 27/24* (2006.01)
*H01F 27/28* (2006.01)

(52) U.S. Cl.
CPC ..... *H01F 27/24* (2013.01); *H01F 27/28* (2013.01)

(58) Field of Classification Search
CPC combination set(s) only.
See application file for complete search history.

(56) References Cited

U.S. PATENT DOCUMENTS 9,183,981 B2 * 11/2015 Ueno ..... H01F 37/00
2012/0092120 A1 * 4/2012 Yoshikawa ..... H01F 27/022 336/220

(Continued)

FOREIGN PATENT DOCUMENTS

JP 2012-253289 A 12/2012
JP 2013-004531 A 1/2013
JP 2016-149453 A 8/2016

OTHER PUBLICATIONS

International Search Report, Application No. PCT/JP2018/004417, dated Apr. 24, 2018. ISA/Japan Patent Office.

*Primary Examiner* — Mang Tin Bik Lian
(74) *Attorney, Agent, or Firm* — Honigman LLP

(57) ABSTRACT

Provided is a reactor that includes: a coil; a magnetic core with an inner core portion arranged inside the coil; and an inwardly interposed member insulating the inner core portion from the coil. The inwardly interposed member has a thin portion defined by a recessed inner-circumferential surface, and a thick portion that is thicker than the thin portion. The inner core portion has a core-side projection portion facing the inwardly interposed member that has a shape conforming to the inner-circumferential surface shape of the thin portion. The thin portion has a thickness of 0.2 mm to 1.0 mm inclusive, and the thick portion has a thickness of 1.1 mm to 2.5 mm inclusive. A clearance is provided at least at a portion between the inner core portion and the inwardly interposed member, and the inwardly (Continued)

interposed member and the wound portion are in contact with each other.

9 Claims, 4 Drawing Sheets

(56) References Cited

U.S. PATENT DOCUMENTS

| | | | | |
|---|---|---|---|---|
| 2012/0126928 | A1* | 5/2012 | Yoshikawa | H01F 37/00 336/221 |
| 2012/0154093 | A1 | 6/2012 | Yoshikawa et al. | |
| 2013/0127574 | A1* | 5/2013 | Uozumi | H01F 27/255 336/180 |
| 2013/0181801 | A1 | 7/2013 | Yoshikawa et al. | |
| 2014/0125308 | A1 | 5/2014 | Yoshikawa et al. | |

* cited by examiner

10 : 2, 3, 4
7, 4, 70, 71

7 : 4, 70, 71

REACTOR

CROSS-REFERENCE TO RELATED APPLICATIONS

This application is the U.S. national stage of PCT/JP2018/004417 filed on Feb. 8, 2018, which claims priority of Japanese Patent Application No. JP 2017-036001 filed on Feb. 28, 2017, the contents of which are incorporated herein.

TECHNICAL FIELD

The present disclosure relates to a reactor.

BACKGROUND

For example, JP 2012-253289A and JP 2013-4531A disclose reactors that are magnetic components used in converters for electric-powered vehicles such as hybrid automobiles. The reactors disclosed in JP 2012-253289A and JP 2013-4531A are provided with a coil with a pair of wound portions, a magnetic core partially arranged inside the wound portions, and a bobbin (insulating interposed member) that ensures insulation between the coil and the magnetic core.

With recent development of electric-powered vehicles, there is a demand for improvement in performance of a reactor. For example, there is a demand for improvement in heat dissipation properties of the reactor, thereby suppressing changes in magnetic characteristics of the reactor that may be caused by heat accumulated in the reactor. There is also a demand for a reactor that is downsized and has improved magnetic characteristics. In order to meet such requirements, reactor configurations are reviewed.

Therefore, it is an object of the present disclosure to provide a reactor that has improved heat dissipation properties. It is also an object of the present disclosure to provide a reactor that is downsized and has improved magnetic characteristics.

SUMMARY

According to the present disclosure, a reactor includes a coil with a wound portion; a magnetic core with an inner core portion arranged inside the wound portion; and an inwardly interposed member configured to ensure insulation between the wound portion and the inner core portion, wherein the inwardly interposed member has a thin portion that is thin as a result of an inner-circumferential surface of the inwardly interposed member being recessed, and a thick portion that is thicker than the thin portion, the inner core portion has, on an outer circumferential surface that faces the inwardly interposed member, a core-side projection portion that has a shape conforming to the shape of the inner-circumferential surface of the thin portion, the thin portion has a thickness of 0.2 mm to 1.0 mm inclusive, and the thick portion has a thickness of 1.1 mm to 2.5 mm inclusive, a clearance is provided at least at a portion between the inner core portion and the inwardly interposed member, and the inwardly interposed member and the wound portion are in substantially intimate contact with each other.

DETAILED DESCRIPTION OF PREFERRED EMBODIMENTS

Figure 1:
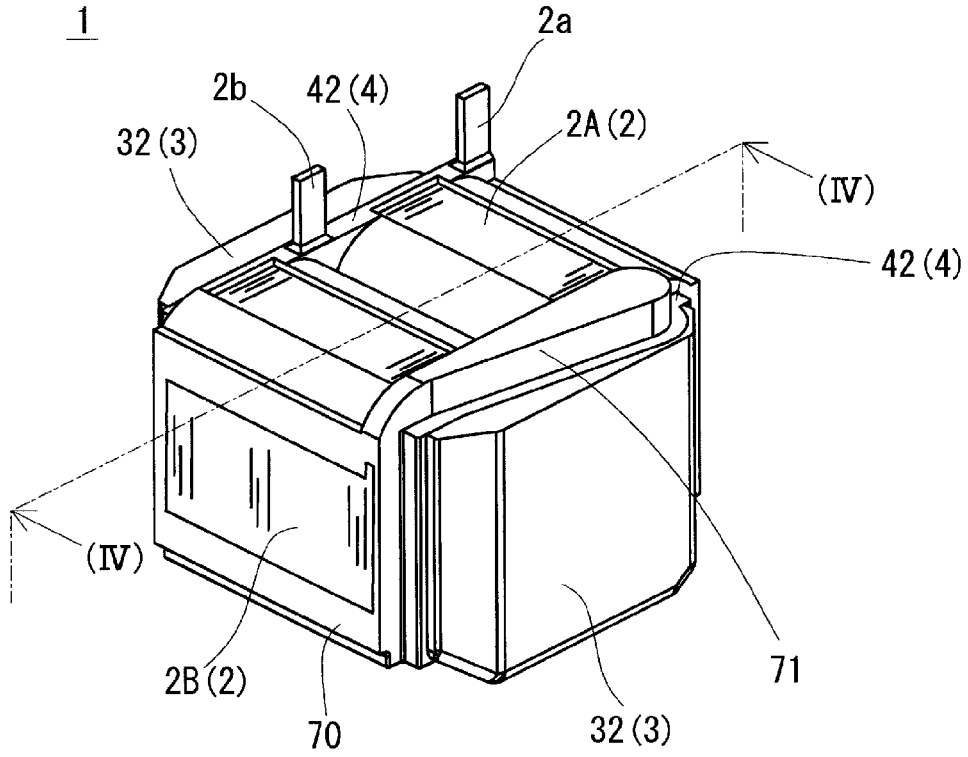
FIG. 1 is a schematic perspective view illustrating a reactor including a coil with a pair of wound portions according to Embodiment 1.

First, embodiments of the disclosure according to the present application will be described sequentially.

Inwardly interposed members are often formed using injection molding. If the inwardly interposed members are thin, the size of the injection molded article is likely to vary. Accordingly, it is conventionally proposed to set the thickness of inwardly interposed members to a given value or more (for example, 2.5 mm or more), or provide ribs or the like on inwardly interposed members as disclosed in Patent Documents 1 and 2, so that the inwardly interposed members have high dimensional accuracy. However, in such a configuration, the distance between a wound portion and an inner core portion is large. Therefore, the dissipation of heat from the inner core portion to the wound portion is constrained, and if the wound portion has a given cross-sectional area, the cross-sectional area of the magnetic path of the inner core portion arranged inside the wound portion cannot be increased to the corresponding given value or more. In view of these issues, the applicants of the present application have accomplished the reactor according to the embodiments below.

According to an embodiment, a reactor includes a coil with a wound portion; a magnetic core with an inner core portion arranged inside the wound portion; and an inwardly interposed member configured to ensure insulation between the wound portion and the inner core portion, wherein the inwardly interposed member has a thin portion that is thin as a result of an inner-circumferential surface of the inwardly interposed member being recessed, and a thick portion that is thicker than the thin portion, the inner core portion has, on an outer circumferential surface that faces the inwardly interposed member, a core-side projection portion that has a shape conforming to the shape of the inner-circumferential surface of the thin portion, the thin portion has a thickness of 0.2 mm to 1.0 mm inclusive, and the thick portion has a thickness of 1.1 mm to 2.5 mm inclusive, a clearance is provided at least at a portion between the inner core portion and the inwardly interposed member, and the inwardly interposed member and the wound portion are in substantially intimate contact with each other.

If the inwardly interposed member is produced using injection molding, in which resin is injected into a mold, the resin injected into a wide space of the mold is to serve as a thick portion, and the resin injected into a narrow space of the mold is to serve as a thin portion. The wide space of the mold functions to let the resin promptly move through all spaces of the mold. Therefore, an inwardly interposed member having a thick portion with a predetermined thickness or more can easily be produced according to the designed size, even if it has a thin portion that is thinner than a conventional one. To bring the inwardly interposed member into substantially intimate contact with the inner circumference of the wound portion of the coil, resin is molded on the wound portion, or the inwardly interposed member is press-fitted into the wound portion. In either case, as a result of being able to produce the inwardly interposed member according to the designed size, the inwardly interposed member can be brought into substantially intimate contact with the inner circumference of the wound portion. Here, in both of the case where resin is molded on the wound portion, and the case where the inwardly interposed member is press-fitted into the wound portion, the interface between the inwardly interposed member and the wound portion may partially include a detached portion. Therefore, even if a portion of the interface is a detached portion, the inwardly interposed member and the wound portion are regarded as being in substantially intimate contact with each other as long as the total area of the detached portion in the entire interface is small (for example, not greater than 40% or 20%).

Little variation in size of the inwardly interposed member makes it possible to suppress such an issue that the inner core portion cannot be inserted into the inwardly interposed member, even if the inwardly interposed member is designed such that there is a small clearance between the inner core portion and the inwardly interposed member.

Since the small clearance can be provided, it is possible to reduce the distance between the inner core portion and the wound portion, and to improve the dissipation of heat from the inner core portion to the wound portion. Moreover, since the wound portion of the coil and the inwardly interposed member are in substantially intimate contact with each other, thermal conductivity between the two components is excellent, and the dissipation of heat from the inner core portion to the wound portion can be improved. Specifically, in the reactor of the embodiments, since the core-side projection portion of the inner core portion is arranged in the recess of the thin portion (hereinafter, also referred to as "interposition-side recess portion"), the distance of heat dissipation from the core-side projection portion to the wound portion is short, and as a result, the heat dissipation properties of the reactor can be improved.

Furthermore, since the small clearance can be provided, it is possible to increase the cross-sectional area of the magnetic path of the inner core portion arranged inside the wound portion, without increasing the size of the wound portion. Specifically, in the reactor of the embodiments, the core-side projection portion of the inner core portion is arranged in the interposition-side recess portion of the inwardly interposed member, and thus the cross-sectional area of the magnetic path of the inner core portion is large. Therefore, it is possible to increase, without changing the size of the wound portion, the cross-sectional area of the magnetic path of the inner core portion compared to a case of a reactor using a conventional inwardly interposed member that includes no interposition-side recess portion.

Furthermore, the configurations of the embodiments include the advantage of ease of suppressing expansion and contraction of the wound portion that may be caused by use of the reactor, using the inwardly interposed member that is in intimate contact with the inner circumference of the wound portion of the coil.

A configuration of the reactor according to the embodiment may be such that the inwardly interposed member is made of resin that is molded inside the wound portion.

When the wound portion is arranged in a mold, and resin is molded inside the wound portion to form the inwardly interposed member, the resin injected into a wide space between the wound portion and the core of the mold that is arranged inside thereof is to serve as a thick portion, and the resin injected into a narrow space of the mold is to serve as a thin portion. By molding the resin on the wound portion to form the inwardly interposed member, it is possible to reliably bring the wound portion and the inwardly interposed member into intimate contact with each other. Furthermore, since the wound portion and the inwardly interposed member can be formed as one piece, it is possible to reduce time and effort required in assembling the wound portion and the inwardly interposed member, thus improving the productivity of the reactor.

A configuration of the reactor according to the embodiment may be such that a difference in the thickness between the thin portion and the thick portion is not less than 0.2 mm.

As a result of a difference in the thickness between the thin portion and the thick portion being set to be not less than 0.2 mm, it is possible to reduce variations in size of the inwardly interposed member, while sufficiently ensuring the filling property of resin into a narrow and small space of the mold that corresponds to the thin portion.

A configuration of the reactor according to the embodiment may be such that the thickness of the thin portion is 0.2 mm to 0.7 mm inclusive, and the thickness of the thick portion is 1.1 mm to 2.0 mm inclusive.

By setting the thickness of the thin portion to be in the above-described range, it is possible to sufficiently reduce the distance between the wound portion and the core-side projection portion of the inner core portion, and improve the heat dissipation properties of the reactor. Furthermore, by setting the thickness of the thick portion to be in the above-described range, it is possible to further reduce variation in sizes of the inwardly interposed members.

A configuration of the reactor according to the embodiment may be such that a plurality of thick portions and a plurality of thin portions are distributed in the circumferential direction of the inwardly interposed member.

In a mold used to produce the inwardly interposed member having the above-described configuration, resin is likely to move through all spaces of the mold when the resin is injected, and thus it is easy to produce an inwardly interposed member with little variation in size. In other words, the inwardly interposed member having the above-described configuration is an inwardly interposed member with little variation in size, and can improve the heat dissipation properties and the magnetic characteristics of the reactor. Specifically, if narrow spaces and wide spaces are alternately arranged side by side in the circumferential direction of the spaces of the mold into which resin is injected, the resin is more likely to move through all spaces of the mold. With such a mold, it is possible to produce an inwardly interposed member whose thick portions and thin portions are alternately arranged side by side in the circumferential direction of the inwardly interposed member, with dimensional accuracy.

A configuration of the reactor according to the embodiment may be such that the thick portion reaches an end face, in the axial direction of the wound portion, of the inwardly interposed member.

When the inwardly interposed member is produced using injection molding, resin is often injected at a position of the mold at which an end face of the inwardly interposed member is to be formed. In this case, the end face of the inwardly interposed member serves as an entrance for the resin, and thus, if there is a large space that corresponds to the thick portion in the entrance for the resin, the moldability of the inwardly interposed member will be improved. Here, when the inwardly interposed member whose thick portion reaches the end face of the inwardly interposed member is produced, the wide space that corresponds to the thick portion is formed in the entrance for the resin. Therefore, the inwardly interposed member having the above-described configuration has improved moldability, and it is possible to accurately produce the inwardly interposed member even if a thin portion has a reduced thickness.

A configuration of the reactor according to the embodiment may be such that the inwardly interposed member has an outer circumferential surface in a shape that conforms to an inner-circumferential surface of the wound portion.

If the outer circumferential surface of the inwardly interposed member conforms to the inner-circumferential surface shape of the wound portion, there is hardly any gap between the inwardly interposed member and the wound portion, and thus it is easy to reduce the size of the clearance provided between the outer circumferential surface of the inner core portion and the inner circumferential surface of the inwardly interposed member. As a result, the heat dissipation properties and the magnetic characteristics of the reactor can be improved with ease.

A configuration of the reactor according to the embodiment may be such that the thickness of the inwardly interposed member gradually increases from the thin portion toward the thick portion.

By employing a configuration in which the thickness of the inwardly interposed member gradually increases from the thin portion to the thick portion, it is possible to improve the moldability of the inwardly interposed member. Examples of the configuration in which the thickness gradually increases from the thin portion to the thick portion include an example in which the portion extending from the thin portion to the thick portion is a curved surface or an inclined surface. The reason why the above-described configuration improves the moldability of the inwardly interposed member is that, when the inwardly interposed member is formed using injection molding, resin injected into the portion of the mold in which the thick portion is to be formed is likely to move through toward the portion in which the thin portion is to be formed.

A configuration of the reactor according to the embodiment may be such that the clearance provided between the inner core portion and the inwardly interposed member is more than 0 mm but is not greater than 0.3 mm.

If the clearance is more than 0 mm but is not greater than 0.3 mm, the heat dissipation properties and the magnetic characteristics of the reactor can further be improved.

Details of Embodiments of Disclosure

Hereinafter, embodiments of the reactor of the disclosure according to the present application will be described with reference to the drawings. The same reference numerals in the drawings denote a constituent component with the same name. Note that the disclosure according to the present application is not limited to the configurations shown in the embodiments but is defined by the claims, and is intended to encompass all modifications in the scope of the claims and equivalent thereto.

Embodiment 1

Overall Configuration

A reactor 1 shown in FIG. 1 is provided with an assembly 10 in which a coil 2, a magnetic core 3, and an insulating interposed member 4 are assembled. An example of a feature of this reactor 1 can be part (later-described inwardly interposed members 41 shown in FIGS. 2, 4, and 5) of the insulating interposed member 4 that has a different shape from a conventional one. First, the constituent components of the reactor 1 will be described briefly with reference to FIGS. 1 to 3, and then the shape of the inwardly interposed members 41, and the relationship between the inwardly interposed members 41, the magnetic core 3, and wound portions 2A and 2B will be described in detail with reference to FIGS. 4 to 6, the magnetic core 3 and the wound portions 2A and 2B being respectively arranged inside and outside the inwardly interposed members 41.

Coil

The coil 2 of the present embodiment is provided with the pair of wound portions 2A and 2B, which are arranged in parallel to each other, and a coupling portion that couples the two wound portions 2A and 2B. End portions 2*a* and 2*b* of the coil 2 are drawn from the wound portions 2A and 2B, and are connected to not-shown terminal members. An external device such as a power supply that supplies electric power to the coil 2 is connected via the terminal members. The wound portions 2A and 2B of the coil 2 of the present example have substantially square tubular shapes with the same number of turns and the same winding direction, and are arranged in parallel to each other so that the axial directions thereof are in parallel to each other. The wound portions 2A and 2B may also have different numbers of turns or different cross-sections of the winding wires. Furthermore, the coupling portion of the present example is formed by bending a winding wire that connects the wound portions 2A and 2B in a flatwise manner, and is covered by a later-described coupling portion covering portion 71 so as not to be viewed from the outside.

The coil 2 including the wound portions 2A and 2B can be formed by a coated wire, which is a conductor, such as a rectangular wire or round wire made of a conductive material such as copper, aluminum, magnesium, or an alloy thereof provided with, on its outer circumferential surface, an insulating coating made of an insulating material. In the present embodiment, the wound portions 2A and 2B are formed by winding a coated rectangular wire in an edge wise manner, the coated rectangular wire having a conductor made of a copper rectangular wire and an enamel (typically, polyamide-imide) insulating coating.

Figure 2:
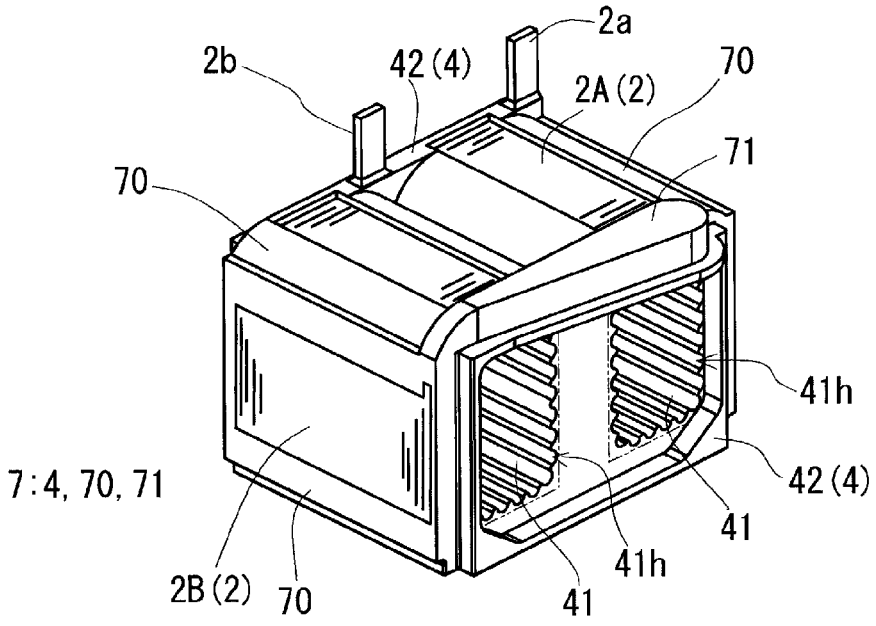
FIG. 2 is a schematic perspective view illustrating a molded coil included in the reactor according to Embodiment 1.

As shown in FIG. 2, the coil 2 of the present example is used with a coil molded portion 7 that is made of an insulating resin. Part of the coil molded portion 7 functions as the later-described insulating interposed member 4.

Magnetic Core

Figure 3:
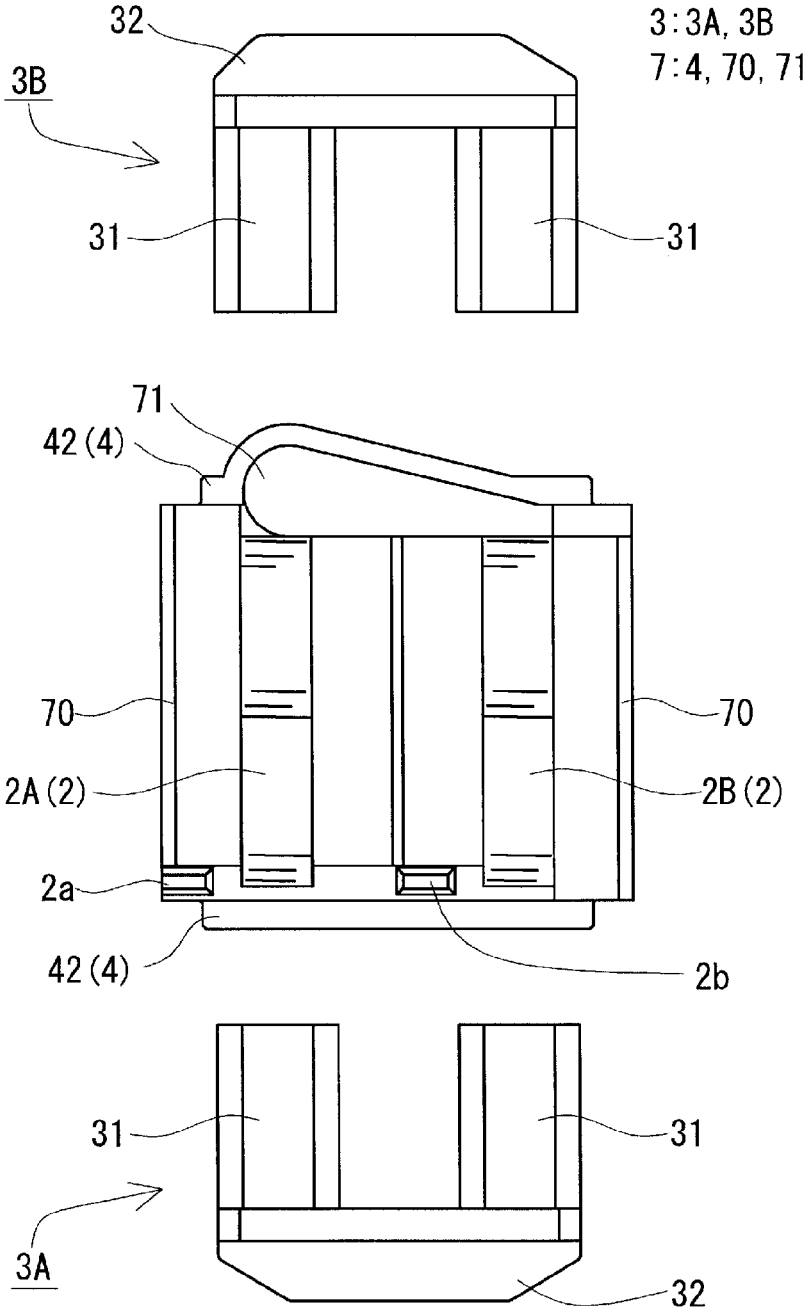
FIG. 3 is an exploded top view illustrating an assembly of the reactor according to Embodiment 1.

As shown in FIG. 3, the magnetic core 3 of the present example is configured by combining two divided cores 3A and 3B, which are substantially U-shaped when viewed from above. For convenience, the magnetic core 3 can be classified into inner core portions 31 and outer core portions 32.

The inner core portions 31 are portions arranged inside the wound portions 2A and 2B of the coil 2. Here, the inner core portions 31 refer to the portions of the magnetic core 3 that extend in the axial directions of the wound portions 2A and 2B of the coil 2. For example, the portions that protrude to the outside from the inside of the wound portions 2A and 2B, that is, from the end faces thereof are also included in the inner core portions 31.

Each of the inner core portions 31 of the present example is constituted by one of the projections of the letter U of the divided core 3A and one of the projections of the letter U of the divided core 3B. A plate-shaped gap material may also be provided between the two projections. The gap material can be made of, for example, a non-magnetic material such as alumina. The rough overall shape of an inner core portion 31 corresponds to the inner shape of the wound portion 2A (2B), and, in the present example, is a substantially cuboid shape.

The outer circumferential surfaces of the inner core portions 31 of the present example have a concave-convex shape, illustration of which is omitted in FIG. 3. The concave-convex shape of the outer circumferential surfaces of the inner core portions 31 corresponds to the shape of the inner circumferential surface of the later-described inwardly interposed members 41. The configuration of the concave-convex shape will be described later in detail with reference to FIG. 4 and the like.

The outer core portions 32 are portions arranged outside the wound portions 2A and 2B, and each have a shape such that they connect ends of a pair of inner core portions 31. Each of the outer core portions 32 of the present example is constituted by the bottom portion of the letter U of the divided core 3A (3B). The lower faces of the outer core portions 32 are substantially flush with the lower faces of the wound portions 2A and 2B of the coil 2 (see FIG. 1). Of course, the two types of lower faces do not necessarily have to be flush with each other.

The divided cores 3A and 3B can be constituted by molded articles made of a composite material that contains soft magnetic powder and resin. The soft magnetic powder is an aggregation of magnetic grains made of an iron group metal such as iron or an alloy thereof (such as a Fe—Si alloy, a Fe—Si—Al alloy, or a Fe—Ni alloy). The magnetic grains may also have, on their surface, an insulating coating made of phosphoric salt or the like. Furthermore, as the resin, a thermosetting resin such as an epoxy resin, a phenol resin, a silicone resin, or an urethane resin, a thermoplastic resin such as a polyphenylene sulfide (PPS) resin, a polyamide (PA) resin such as nylon 6 or nylon 66, a polyimide resin, or a fluorine resin, or the like may be used, for example.

The content of the soft magnetic powder in the composite material may be from 50% by volume to 80% by volume inclusive, out of 100% of the composite material. If the content of the magnetic powder is not less than 50% by volume and the ratio of the magnetic component is sufficiently thus high, it is easy to increase the saturation flux density. If the content of the magnetic powder is not greater than 80% by volume, the composite of the magnetic powder and the resin may have high fluidity, resulting in a composite material with improved moldability. The lower limit of the content of the magnetic powder may be not less than 60% by volume. Furthermore, the upper limit of the content of the magnetic powder may be not greater than 75% by volume, and more specifically not greater than 70% by volume.

In contrast to the present example, the divided cores 3A and 3B may also be constituted by compressed powder molded articles obtained by compressing and molding raw powder containing soft magnetic powder. The same soft magnetic powder as that usable for a molded article made of the composite material may be used for the soft magnetic powder. Because the projections of the divided cores 3A and 3B are inserted into the later-described inwardly interposed members 41 of the insulating interposed member 4, it is also possible to form a resin molded portion on the outer circumferences of the compressed powder molded articles to protect the compressed powder molded articles.

Insulating Interposed Member

The insulating interposed member 4 is a member that ensures insulation between the coil 2 and the magnetic core 3. In the present example, the insulating interposed member 4 is formed as part of the coil molded portion 7 obtained by molding resin on the wound portions 2A and 2B. The coil molded portion 7 includes the insulating interposed member 4, turn covering portions 70 that integrate turns into one piece at curved corner positions on the outer circumferential side of the wound portions 2A and 2B, and the coupling portion covering portion 71 that covers the coupling portion (not shown) of the wound portions 2A and 2B.

Figure 4:
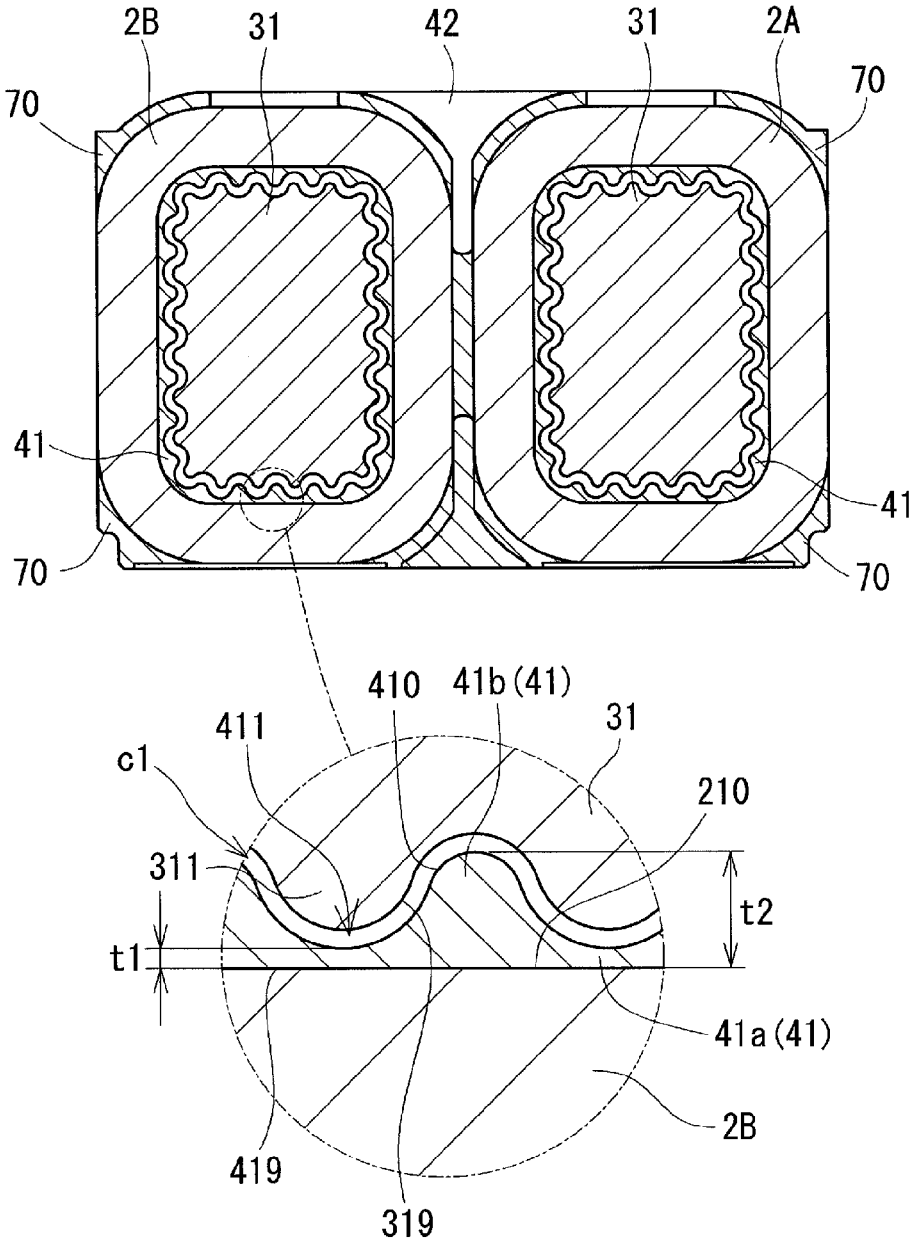
FIG. 4 shows a cross-sectional view taken along a line IV-IV in FIG. 1 with a partially enlarged view thereof.

As shown in FIG. 2, the insulating interposed member 4, which is formed as part of the coil molded portion 7, is provided with a pair of inwardly interposed members 41 and a pair of end-face interposed members 42. Each inwardly interposed member 41 is formed inside the wound portion 2A (2B), and is interposed between the inner circumferential surface of the wound portion 2A (2B) and the outer circumferential surface of the inner core portion 31 (FIG. 4). Each end-face interposed member 42 is arranged on one end face (the other end face), in the axial directions of the wound portions 2A and 2B, and is interposed between end faces of the wound portions 2A and 2B and an outer core portion 32 (FIG. 1).

The internal areas of dashed-two dotted lines of the end-face interposed member 42 indicate the inwardly interposed members 41. Accordingly, the end-face interposed member 42 has through holes 41*h* that are open in the inwardly interposed members 41. The openings of the through holes 41*h* serve as entrances via which the inner core portions 31 are inserted into the inwardly interposed members 41. The inner circumferential surfaces of the inwardly interposed members 41 that form the through holes 41*h* have a concave-convex shape. This will be described later with reference to FIGS. 4 and 5.

The end-face interposed members 42 are frame-shaped while protruding away from the coil 2 in the axial directions of the wound portions 2A and 2B. A configuration is employed in which the outer core portions 32 (FIG. 1) are fitted to the frame-shaped end-face interposed members 42.

The insulating interposed member 4 having the above-described configuration can be formed of, for example, a thermoplastic resin such as a PPS resin, a polytetrafluoroethylene (PTFE) resin, a liquid crystal polymer (LCP), a PA resin such as nylon 6 or nylon 66, a polybutylene terephthalate (PBT) resin, or an acrylonitrile butadiene styrene (ABS) resin. Alternatively, the insulating interposed member 4 can also be formed of a thermosetting resin such as an unsaturated polyester resin, an epoxy resin, a urethane resin, or a silicone resin. A ceramic filler may also be added to the above-described resin to improve the heat dissipation properties of the insulating interposed member 4. As the ceramic filler, a non-magnetic powder such as alumina or silica may be used, for example.

Other Configuration

The reactor 1 of the present example has a configuration without a casing, but may also have a configuration in which the assembly 10 is arranged inside a casing.

Relationship Between Inwardly Interposed Member, Inner Core Portion, and Wound Portion FIG. 4 is a cross-sectional view taken along a line IV-IV in FIG. 1 that is orthogonal to the axial directions of the wound portions 2A and 2B. In FIG. 4, the illustration of the end portions 2*a* and 2*b* of the coil 2 is omitted. Furthermore, in FIG. 4, the shapes of the constituent components are shown in an exaggerated manner.

As shown in an enlarged view in the circle in FIG. 4, the inwardly interposed member 41 has, on an inner circumferential surface 410 thereof, a plurality of interposition-side recess portions 411. The inwardly interposed member 41 has thin portions 41*a* obtained as a result of the inner-circumferential surface 410 being recessed due to the interposition-side recess portions 411, and thick portions 41*b* that are thicker than the thin portions 41*a*.

Figure 5:
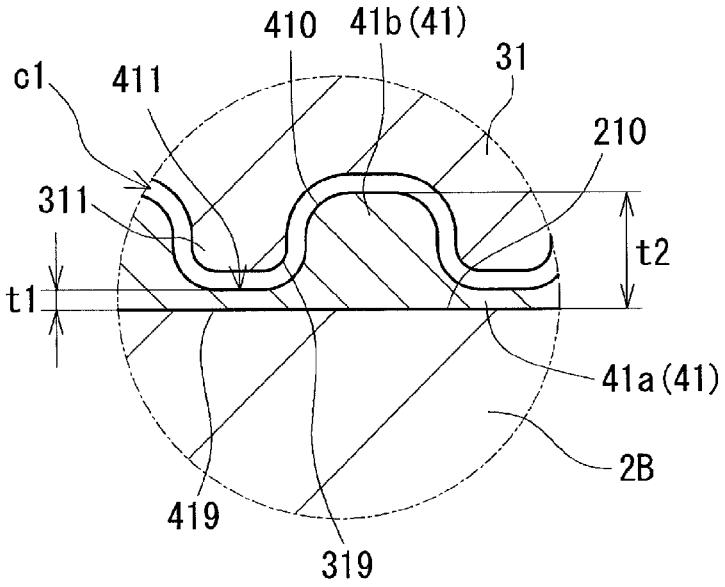
FIG. 5 is a partially enlarged view illustrating the positional relationship between an inwardly interposed member with an interposition-side recess portion that is different from that of FIG. 4, an inner core portion, and a wound portion, the inner core portion and the wound portion being respectively arranged inside and outside the inwardly interposed member.

The shape of the inner-circumferential surfaces of the interposition-side recess portions 411 in a cross section that is orthogonal to a direction in which the interposition-side recess portions 411 extend (that is a direction of depth of the paper of FIG. 4, and is the same as the axial directions of the wound portions 2A and 2B) is not particularly limited. For example, the shape of the inner-circumferential surfaces of the interposition-side recess portions 411 may also be a semi-arc shape as shown in FIG. 4, or a substantially rectangular shape as shown in FIG. 5. Alternatively, the shape of the inner-circumferential surfaces of the interposition-side recess portions 411 may also be a V-groove shape or a dovetail groove shape.

The thin portions 41*a* have a thickness t1 of 0.2 mm to 1.0 mm inclusive, and the thick portions 41*b* have a thickness t2 of 1.1 mm to 2.5 mm inclusive. Here, the thickness t1 of the thin portions 41*a* refers to the thickness of the portions of the interposition-side recess portions 411 that correspond to the deepest position as shown in FIGS. 4 and 5, that is, the smallest thickness of the thin portions 41*a*. The thickness t1 of the thin portions 41*a* is clearly thinner than the thickness (for example, 2.5 mm) of a conventional inwardly interposed member with a uniform thickness. Furthermore, the thickness t2 of the thick portions 41*b* refers to the greatest thickness of the portions in which there is no interposition-side recess portion 411.

If the inwardly interposed members 41 having the above-described configuration are produced inside the wound portions 2A and 2B using injection molding, the resin injected into wide spaces of a mold for use in the injection molding is to serve as the thick portions 41*b*, and the resin injected into narrow spaces of the mold is to serve as the thin portions 41*a*. The wide spaces of the mold function to let the resin promptly move through all spaces of the mold. Therefore, inwardly interposed members 41 having thick portions 41*b* with a predetermined thickness or more can easily be produced according to the designed size even if they have thin portions 41*a* that are thinner than conventional ones, thus making it possible to bring the inwardly interposed members 41 into substantially intimate contact with the inner circumferential surfaces 210 of the wound portions 2A and 2B. If the inwardly interposed members 41 have little variation in size, the inwardly interposed members 41 can be designed so that there is a small inner clearance c1 between an inner core portion 31 and an inwardly interposed member 41. Even if the inwardly interposed members 41 are designed so that there is a small inner clearance c1, due to the high dimensional accuracy of the inwardly interposed members 41, such an issue that the inner core portions 31 cannot be inserted into the inwardly interposed members 41 is unlikely to occur.

Taking the moldability of the inwardly interposed members 41 into consideration, the plurality of interposition-side recess portions 411 are preferably distributed in the circumferential direction of the inner-circumferential surfaces 410 of the inwardly interposed members 41. In other words, this configuration is such that the plurality of thick portions 41*b* and the plurality of thin portions 41*a* are distributed in the circumferential direction of the inwardly interposed member 41. The mold used to produce the inwardly interposed member 41 is such that a narrow space and a wide space are alternately arranged side by side in the circumferential direction of the spaces of the mold into which resin is injected. With such a mold, when resin is injected, the resin is likely to move through all spaces of the mold, and it is easy to produce inwardly interposed member 41 with little variation in size. Specifically, with the configuration, as in the present example, in which the thin portions 41*a* and the thick portions 41*b* extend in the axial direction of the inwardly interposed member 41, it is easier to fill the mold with resin at the time of molding.

Furthermore, taking the moldability of the inwardly interposed members 41 into consideration, the thick portions 41*b* preferably reach the end faces, in the axial direction of the wound portions 2A and 2B, of the inwardly interposed members 41. It is preferable that, as shown in FIG. 2, all of the thick portions 41*b* reach the end faces of the inwardly interposed members 41. When an inwardly interposed member 41 is produced using injection molding, resin is often injected at a position of the mold at which an end face of the inwardly interposed member 41 is to be formed. In this case, if the space of the mold that serves as an entrance for the resin is large, the moldability of the inwardly interposed member 41 is improved. In other words, the inwardly interposed member 41 provided with the thick portions 41*b* that reach the end faces of the inwardly interposed member 41 is superior in terms of moldability, and can be accurately produced even if it has the thin portions 41*a* with a small thickness.

Figure 6:
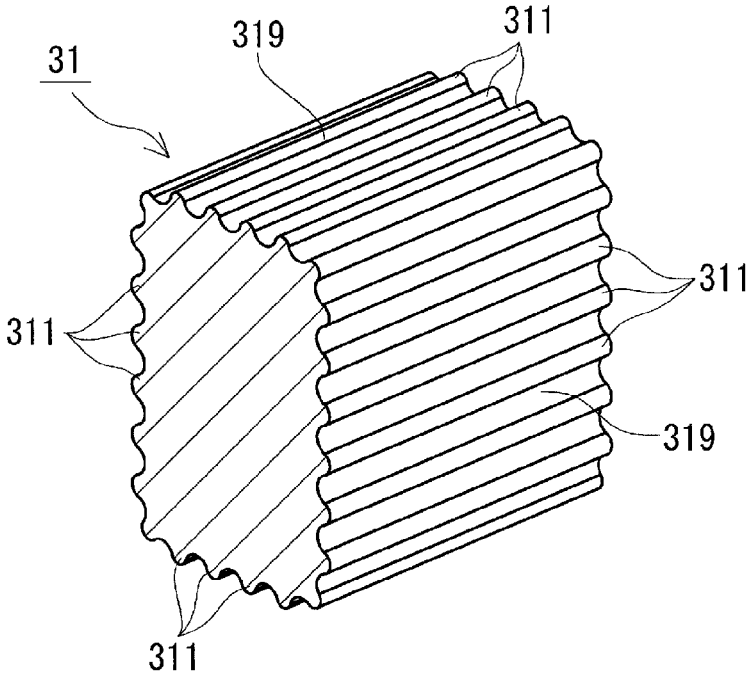
FIG. 6 is a schematic perspective view illustrating the inner core portion according to Embodiment 1.

On the other hand, each inner core portion 31 that is arranged inside an inwardly interposed member 41 (through hole 41*h*) is provided with core-side projection portions 311 formed on the outer circumferential surface thereof (core outer circumferential surface 319) (see FIG. 6 as well). The core-side projection portions 311 have a shape that corresponds to the interposition-side recess portions 411 formed in the inner-circumferential surface 410 of the corresponding inwardly interposed member 41. As described above, the thin portions 41*a* of the inwardly interposed member 41 in which the interposition-side recess portions 411 are respectively formed are thinner than a conventional inwardly interposed member with a uniform thickness. Therefore, the cross section of a magnetic path of an inner core portion 31 that has the core-side projection portions 311 arranged in the interposition-side recess portions 411 is certainly larger than that of a conventional inner core portion by the size of the core-side projection portions 311.

The core-side projection portions 311 are preferably formed such that the inner clearances c1 are substantially uniform irrespective of positions of the thin portions 41*a* or positions of the thick portions 41*b*. Furthermore, the uniform inner clearances c1 may be set to be more than 0 mm but is not greater than 0.3 mm, in view of ease of production of an inwardly interposed member 41 according to the designed size. As a result of being able to reduce the size of the inner clearances c1, it is possible to reduce the distances between the inner core portions 31 and the wound portions 2A and 2B, and to improve the dissipation of heat from the inner core portions 31 to the wound portions 2A and 2B. Furthermore, as a result of being able to reduce the size of the inner clearances c1, if the wound portions 2A and 2B have the same size, the cross-sectional areas of the magnetic paths of the inner core portions 31 can be increased compared to a case where conventional inwardly interposed members are used. The inner clearances c1 are preferably not greater than 0.2 mm, and more preferably not greater than 0.1 mm, in view of ease of insertion of the inner core portions 31 into the through holes 41*h* of the inwardly interposed members 41, the effects of improving the dissipation of heat from the inner core portions 31 to the wound portions 2A and 2B, and the effects of increasing the cross-sectional areas of the magnetic paths of the inner core portions 31.

An outer circumferential surface 419 of the inwardly interposed member 41 preferably has a shape that conforms to the shape of the inner-circumferential surface of the wound portions 2A and 2B. With this, there is hardly any gap between the inwardly interposed members 41 and the wound portions 2A and 2B, and it is thus possible to reduce the distance between the inner core portions 31 to the wound portions 2A and 2B. As a result, it is possible to improve the dissipation of heat from the inner core portions 31 to the wound portions 2A and 2B, and to ensure a large cross section of the magnetic path of the inner core portion 31.

More Preferable Configuration

Taking the wide spaces of the mold that correspond to the thick portions 41*b* realizing excellent moldability of the inwardly interposed members 41 into consideration, a difference between the thickness t1 of the thin portions 41*a* and the thickness t2 of the thick portions 41*b* (thickness t2−thickness t1) is preferably set to be not less than 0.2 mm. If specific numerical values are to be defined for the thin portions 41*a* and the thick portions 41*b*, the thickness t1 of the thin portions 41*a* is preferably 0.2 mm to 0.7 mm inclusive, and the thickness t2 of the thick portions 41*b* is preferably 1.1 mm to 2.0 mm inclusive. The thickness t1 of the thin portions 41*a* is more preferably 0.2 mm to 0.5 mm inclusive, and the thickness t2 of the thick portions 41*b* is more preferably 1.1 mm to 2.0 mm inclusive.

By employing a configuration in which the thickness of the inwardly interposed members 41 gradually increases from a thin portion 41*a* toward a thick portion 41*b*, it is possible to improve the moldability of the inwardly interposed member 41. This is because, when the inwardly interposed member 41 is molded using injection molding, resin injected into the portion of the mold in which the thick portions 41*b* are to be formed easily enters the portion in which the thin portions 41*a* are to be formed. As a specific example of this configuration, as shown in, for example, FIGS. 4 and 5, width-directional edge portions (edge portions in the direction in which thick portions 41*b* are present) of a thin portion 41*a* may have a shape such that they are rounded and recessed toward the outside of the inwardly interposed member 41. Furthermore, it is also preferable that width-directional edge portions (edge portions in the direction in which thin portions 41*a* are present) of a thick portion 41*b* have a shape such that they are rounded and protrude toward the outside of the inwardly interposed member 41. The width directional edge portions may be arc-shaped, and in this case, the radius of curvature of the arc may be 0.05 mm to 20 mm inclusive, and more preferably 0.1 mm to 10 mm inclusive. If the arc has a large radius of curvature, as shown in FIG. 4, a width-directional edge portion of a thin portion 41*a* and a width-directional edge portion of a thick portion 41*b* appear to be connected to each other, and the inner-circumferential surface 410 of the inwardly interposed member 41 is wave-shaped. If the arc has a small radius of curvature, as shown in FIG. 5, the inner-circumferential surface 410 of the inwardly interposed member 41 has a shape such that interposition-side recess portions 411 in the shape of rounded rectangular grooves are arranged side by side. Alternatively, the inner-circumferential surface 410 may also have a shape such that interposition-side recess portions 411 in the shape of round V-shaped grooves are arranged side by side.

In the configuration in which the inner core portions 31 are inserted into the inwardly interposed members 41, every thick portion 41*b* is preferably formed spanning from the end face on one end side to the end face on the other end side, in the axial direction, of the corresponding inwardly interposed member 41 (the axial direction being the same as the axial directions of the wound portions 2A and 2B). This is because, if resin is injected at a position of a mold at which an end face of the inwardly interposed member 41 is to be formed, the end face of the inwardly interposed member 41 serves as an entrance for the resin, and thus if there are large spaces that correspond to the thick portions 41*b* in the entrance for the resin, the moldability of the inwardly interposed member 41 is improved. In other words, the shape of the inwardly interposed member 41 is such that interposition-side recess portions 411 (thin portions 41*a*) span from the end face on one end side to the end face on the other end side, in the axial direction, of the inwardly interposed member 41. The inner core portion 31 that corresponds to the inwardly interposed member 41 is provided with, as shown in FIG. 6, the plurality of core-side projection portions 311 formed on the core outer circumferential surface 319 thereof. The core-side projection portions 311 shown in FIG. 6 are formed in the shape of projections and extend in the axial direction of the inner core portion 31, and the core-side projection portions 311 are arranged at predetermined intervals in the circumferential direction of the core outer circumferential surface 319. When the inner core portion 31 having the core outer circumferential surface 319 shown in FIG. 6 is inserted into the inwardly interposed member 41, the inner core portion 31 can be smoothly inserted into the inwardly interposed member 41, without being displaced relative to the inwardly interposed member 41.

Reactor Manufacturing Method

As shown in FIG. 3, the reactor 1 of Embodiment 1 can be produced by separately producing the coil 2 including the coil molded portion 7, and the divided cores 3A and 3B, and assembling them. Specifically, the projections of the divided cores 3A and 3B are inserted into the through holes 41*h* (FIG. 2) of the inwardly interposed members 41 formed by the coil molded portion 7 of the coil 2. Gap materials may also be interposed between the pairs of projections of the divided cores 3A and 3B that abut against each other.

Modification 1-1

The divided state of the magnetic core 3 is not limited to the example of Embodiment 1. For example, two substantially J-shaped divided cores may also be combined with each other to form the magnetic core. Also, four portions, namely, a pair of inner core portions and a pair of outer core portions may also be combined with each other to form the magnetic core. Of course, a plurality of divided cores may also be combined with each other to form a single inner core portion.

Embodiment 2

Embodiment 1 described a configuration in which the coil 2 is provided with the pair of wound portions 2A and 2B. Alternatively, the same configuration as in Embodiment 1 may be applied to a reactor that includes a coil provided with a single wound portion.

If a coil provided with a single wound portion is used, the magnetic core is preferably formed by combining two divided cores that are substantially E-shaped when viewed from above. In this case, the projections at the center of the letters E of the divided cores are inserted into an inwardly interposed member to form an inner core portion. Furthermore, the portions other than the projections at the center of the letters E of the divided cores form an outer core portion. Needless to say, the divided state of the magnetic core is not limited to the E-shape.

Also in the present example, similar to Embodiment 1, the inwardly interposed member with thin portions and thick portions is preferably interposed between the wound portion and the inner core portion.

Usage

The reactor according to the embodiments is applicable to a power conversion device such as a bidirectional DC/DC converter installed in an electric-powered vehicle such as a hybrid automobile, an electric automobile, or a fuel-cell-powered automobile.

The invention claimed is:

1. A reactor comprising:

a coil with a wound portion;

a magnetic core with an inner core portion arranged inside the wound portion; and an inwardly interposed member configured to ensure insulation between the wound portion and the inner core portion, wherein the inwardly interposed member has a thin portion that is thin as a result of an inner-circumferential surface of the inwardly interposed member being recessed, and a thick portion that is thicker than the thin portion, the inner core portion has, on an outer circumferential surface that faces the inwardly interposed member, a core-side projection portion that has a shape conforming to the shape of the inner-circumferential surface of the thin portion, the thin portion has a thickness of 0.2 mm to 1.0 mm inclusive, and the thick portion has a thickness of 1.1 mm to 2.5 mm inclusive, a clearance is provided at least at a portion between the inner core portion and the inwardly interposed member, and the inwardly interposed member and the wound portion are in substantially intimate contact with each other.

2. The reactor according to claim 1, wherein the inwardly interposed member is made of resin that is molded inside the wound portion.

3. The reactor according to claim 1, wherein a difference in the thickness between the thin portion and the thick portion is not less than 0.2 mm.

4. The reactor according to claim 1, wherein the thickness of the thin portion is 0.2 mm to 0.7 mm inclusive, and the thickness of the thick portion is 1.1 mm to 2.0 mm inclusive.

5. The reactor according to any claim 1, wherein a plurality of thick portions and a plurality of thin portions are distributed in the circumferential direction of the inwardly interposed member.

6. The reactor according to any claim 1, wherein the thick portion reaches an end face, in the axial direction of the wound portion, of the inwardly interposed member.

7. The reactor according to any claim 1, wherein the inwardly interposed member has an outer circumferential surface in a shape that conforms to an inner-circumferential surface of the wound portion.

8. The reactor according to claim 1, wherein the thickness of the inwardly interposed member gradually increases from the thin portion toward the thick portion.

9. The reactor according to claim 1, wherein the clearance provided between the inner core portion and the inwardly interposed member is more than 0 mm but is not greater than 0.3 mm.

* * * * *